US006470162B2

(12) United States Patent
Abe et al.

(10) Patent No.: US 6,470,162 B2
(45) Date of Patent: Oct. 22, 2002

(54) CONDUCTIVE MEMBER, PROCESS CARTRIDGE AND ELECTROPHOTOGRAPHIC APPARATUS

(75) Inventors: Hiroshi Abe; Akihiro Suzuki, both of Ibaraki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/918,466

(22) Filed: Aug. 1, 2001

(65) Prior Publication Data

US 2002/0039500 A1 Apr. 4, 2002

(30) Foreign Application Priority Data

Aug. 2, 2000 (JP) ..... 2000-234826

(51) Int. Cl.[7] ..... G03G 15/02
(52) U.S. Cl. ..... 399/176
(58) Field of Search ..... 399/166, 174, 399/176, 111, 115; 428/403, 466, 906; 423/414; 492/53, 54, 56; 430/902, 55

(56) References Cited

U.S. PATENT DOCUMENTS

| | | | | |
|---|---|---|---|---|
| 4,851,960 A | | 7/1989 | Nakamura et al. | 361/225 |
| 4,967,231 A | | 10/1990 | Hosoya et al. | 399/176 |
| 6,004,669 A | | 12/1999 | Rokutan et al. | 428/335 |
| 6,259,875 B1 | * | 7/2001 | Mimura et al. | 399/176 |
| 6,372,347 B1 | * | 4/2002 | Yamaguchi et al. | 428/403 |

FOREIGN PATENT DOCUMENTS

| | | |
|---|---|---|
| EP | 0848038 | 6/1998 |
| EP | 0997789 | 5/2000 |
| JP | 63-149669 | 6/1988 |
| JP | 1-211799 | 8/1989 |
| JP | 5-2313 | 1/1993 |
| JP | 5-96648 | 4/1993 |
| JP | 6-58325 | 3/1994 |
| JP | 8-137186 | 5/1996 |
| JP | 10-228156 | 8/1998 |
| JP | 11-125952 | 5/1999 |

* cited by examiner

*Primary Examiner*—Sophia S. Chen
*Assistant Examiner*—Hoan Tran
(74) *Attorney, Agent, or Firm*—Fitzpatrick, Cella, Harper & Scinto

(57) ABSTRACT

A conductive member which is to be disposed in contact with an electrophotographic photosensitive member and to which a voltage is to be applied; and which includes a support member and a conductive covering layer provided on the support member. The conductive covering layer includes both a first carbon black having a DBP oil absorption of from 300 $cm^3$/100 g to 500 $cm^3$/100 g and a second carbon black having a DBP oil absorption of 250 $cm^3$/100 g or smaller and showing a pH of 5 or below. Also disclosed are a process cartridge and an electrophotographic apparatus which make use of the conductive member as a primary charging roller.

21 Claims, 1 Drawing Sheet

CONDUCTIVE MEMBER, PROCESS CARTRIDGE AND ELECTROPHOTOGRAPHIC APPARATUS

BACKGROUND OF THE INVENTION

1. Field of the Invention

This invention relates to a conductive member, and more particularly to a conductive member used in a contact charging assembly, which is disposed in contact with an electrophotographic photosensitive member and to which a voltage is applied to charge the surface of the electrophotographic photosensitive member to a stated potential.

2. Related Background Art

A number of methods for electrophotography are conventionally known. Copies are commonly obtained by forming an electrostatic latent image on a photosensitive member by utilizing a photoconductive material and by various means, subsequently developing the latent image by the use of a toner to form a visible image (toner image), transferring the toner image to a transfer medium such as paper as the occasion demands, and thereafter fixing the toner image to the transfer medium by heat and/or pressure. Toner particles that have not transferred to the transfer medium and remain on the photosensitive member are removed from the photosensitive member through a cleaning step.

Corona charging assemblies have conventionally been used as charging assemblies for electrophotography. In recent years, in place of these, contact charging assemblies have been put into practical use. This aims at low ozone and low power consumption. In particular, a roller charging system making used of a conductive roller as a charging member is preferably used in view of the stability of charging.

In such roller charging, an elastic roller is brought into contact with a member to be charged and a voltage is applied thereto to charge the member electrostatically.

Stated specifically, the charging is performed by the release of electric energy from the charging member to the member to be charged, and hence the charging begins upon application of a voltage not lower than a certain threshold voltage. For example, when a charging roller is brought into pressure contact with an organic photoconductor electrophotographic photosensitive member (OPC electrophotographic photosensitive member) having a photosensitive layer of 25 $\mu$m thick, the surface potential of the electrophotographic photosensitive member begins to rise upon application of a voltage of about 640 V or higher as absolute value, and then, the surface potential of the electrophotographic photosensitive member increases linearly at a slope of 1 with respect to the applied voltage. Hereinafter, this threshold voltage is defined as charging start voltage Vth.

Namely, in order to attain the surface potential Vd of an electrophotographic photosensitive member that is considered necessary for electrophotography, a DC voltage of Vd+Vth, which is beyond the level considered necessary for the image formation itself, is required for the charging roller. This method, in which only a DC voltage is applied to the contact charging member in this way to perform the charging, is called DC charging.

In the DC charging, however, it has been difficult to keep the potential of the electrophotographic photosensitive member at a desired value because the electrical resistance value of the contact charging member tends to vary depending on environmental variations and also because any change in layer thickness as a result of abrasion of the electrophotographic photosensitive member may cause variations of the Vth.

Accordingly, in order to make the charging much more uniform, as disclosed in Japanese Patent Application Laid-open No. 63-149669, an AC+DC charging system is used in which a voltage formed by superimposing on a DC voltage corresponding to a desired Vd an AC component having a peak-to-peak voltage of 2×Vth or higher is applied to the contact charging member. This aims at the effect of leveling the potential by AC, where the potential of the member to be charged converges at the Vd that is the middle of a peak of AC voltage, and can be affected with difficulty by any external disorder such as environmental variations.

As conductive members used for charging, U.S. Pat. No. 4,967,231 discloses an example in which a conductive seamless tube is used to form a surface layer on a conductive support member. Also, Japanese Patent Application Laid-open No. 5-2313 discloses a seamless tube comprised of a fluorine resin, and Japanese Patent Application Laid-open No. 5-96648 discloses a multi-layer tube constituted of layers having different conductivities. As methods concerning the production of charging members, the above prior art U.S. Patent teaches a method of forming the surface layer by inserting the support member into the seamless tube. Japanese Patent Application Laid-open No. 6-58325 also discloses a method of forming a surface layer by the use of a cross-head extruder.

Such methods of forming a roller layer by using the seamless tube enable more uniform changing to be performed with ease because, even when a foam is used as an elastic layer formed on a substrate, a smooth surface can be formed by further covering it with the seamless tube.

As a method of endowing the seamless tube with conductivity, it may commonly include a method of ion conduction which uses salt as a conducting agent and a method of electron conduction which uses a conducting substance such as carbon black or conductive metal oxide powder as a conducting agent. In the case when the seamless tube is endowed with conductivity by ion conduction, the electrical resistance value tends to greatly vary depending on environment. Also, there is such a problem that, since the seamless tube comes into contact with the electrophotographic photosensitive member, the salt tends to contaminate the photosensitive member.

However, in the case when the conducting substance such as carbon or conductive metal oxide powder is incorporated in an insulating material, there has been such a disadvantage that the electrical resistance tends to increase because of repetitive electrification. Especially when the electrical resistance is to be kept low, the conducting agent must be incorporated in a large quantity. Incorporating the conducting agent in a large quantity makes it easy to control the increase in electrical resistance. However, when the electrical resistance is kept at a medium resistance of about $1\times10^4$ to $1\times10^{11}$ Ω·cm, which is required for the covering layer of the conductive member, there is also a limit of the quantity of the conducting agent. Thus, it has been difficult to well control the increase in electrical resistance due to electrification.

SUMMARY OF THE INVENTION

An object of the present invention is to provide a conductive member which may cause, even when successively electrified, less variations in the value of electrical resistance in the medium resistance region ($1\times10^4$ to $1\times10^{11}$ Ω·cm), has less scattering of the electrical resistance value and is superior in production stability.

Another object of the present invention is to provide a process cartridge and an electrophotographic apparatus which have such a conductive member.

The present invention provides a conductive member which is to be disposed in contact with an electrophotographic photosensitive member and to which a voltage is to be applied; the conductive member comprising a support member and a conductive covering layer provided on the support member;

the conductive covering layer comprising both a first carbon black having a DBP oil absorption of from 300 $cm^3$/100 g to 500 $cm^3$/100 g and a second carbon black having a DBP oil absorption of 250 $cm^3$/100 g or smaller and exhibiting the pH of 5 or below.

The present invention also provides a process cartridge and an electrophotographic apparatus which have the above conductive member.

DESCRIPTION OF THE PREFERRED EMBODIMENTS

Figure 1:
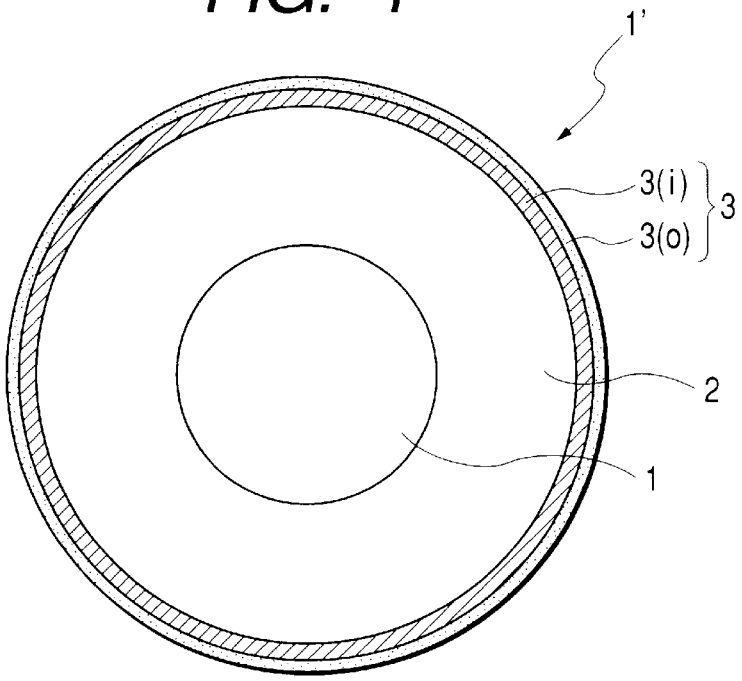
FIG. 1 illustrates an example of the layer construction of the conductive member of the present invention.

The conductive member of the present invention comprises a support member and a conductive covering layer provided on the support member, and the conductive covering layer contains both a first carbon black having a DBP (dibutyl phthalate) oil absorption of from 300 to 500 $cm^3$/100 g and a second carbon black having a DBP oil absorption of 250 $cm^3$/100 g or smaller and exhibiting the pH of 5 or below.

The first carbon black used in the present invention has a DBP oil absorption of from 300 to 500 $cm^3$/100 g, and may preferably have a DBP oil absorption of from 300 to 400 $cm^3$/100 g. Such carbon black may specifically include KETJEN BLACK EC (DBP oil absorption: 360 $cm^3$/100 g) and KETJEN BLACK 600JD (DBP oil absorption: 495 $cm^3$/100 g) (both are trade names; available from Lion Akzo Co., Ltd.), PRINTEX XE-2 (DBP oil absorption: 380 $cm^3$/100 g) (trade name; available from Degussa Corp.), ASAHI HS-500 (DBP oil absorption: 500 $cm^3$/100 g) (trade name; available from Asahi Carbon Co., Ltd.), and BLACK PEARLS 2000 (DBP oil absorption: 330 $cm^3$/100 g) (trade name; available from Cabot Corp.).

The carbon black of these types can attain a high conductivity even when used only in a small quantity. Hence, when only the first carbon black is used as a conducting agent, the content of carbon black that is necessary for obtaining the desired electrical resistance is so small as to tend to cause a great increase in electrical resistance at the time of electrification.

On the other hand, the second carbon black has a DBP oil absorption of 250 $cm^3$/100 g or smaller, and may preferably have a DBP oil absorption of from 30 to 100 $cm^3$/100 g. It may also preferably have a PH of 5 or below. Such carbon black may specifically include SPECIAL BLACK series (DBP oil absorption: 45 to 230 $cm^3$/100 g) (trade name; available from Degussa Corp.), BLACK PEARLS series (DBP oil absorption: 60 to 105 $cm^3$/100 g) (trade name; available from Cabot Corp.), and HCF series (DBP oil absorption: 44 to 73 $cm^3$/100 g), MCF series (DBP oil absorption: 56 to 79 $cm^3$/100 g) and LFF series (DBP oil absorption: 57 to 113 $cm^3$/100 g) (these are trade names; available from Mitsubishi Chemical Corporation).

It is hard for the carbon black of these types to attain conductivity unless being used in some quantity. Hence, when only the second carbon black is used as a conducting agent, the content of carbon black that is necessary for obtaining the desired electrical resistance is relatively large and the increase in electrical resistance due to electrification is sufficiently controlled and the uniformity of conductivity is also improved. From this point of view, the carbon black may preferably be acidic so that it can be incorporated in a larger quantity. Accordingly, in the present invention, it may have the pH of 5 or below, and preferably 4 or below. However, if it is contained in a too large quantity, a material for the covering layer may be so hard as to have a poor elasticity and make it difficult to cover the support member.

Thus, in the present invention, the use of the first carbon black and second carbon black in combination makes it possible to keep the medium resistance region (volume resistivity of from $1\times10^4$ to $1\times10^{11}$ Ω·cm) on account of the balancing of the both, and hence has made it possible to provide a conductive member having a very good resistance stability.

The carbon black may preferably be used in a proportion of the first carbon black: the second carbon black=1:1 to 1:15, and particularly preferably 1:2 to 1:10.

The carbon black may also preferably be mixed in a total carbon black content of from 5 to 50 parts by weight, and particularly preferably from 20 to 40 parts by weight, based on 100 parts by weight of the binder resin described below. If it is less than 5 parts by weight, the conductive member may have a non-uniform conductivity to cause uneven charging, or may have so high an electrical resistance that the photosensitive member is hard to charge. If it is more than 50 parts by weight, the mixture may have so high a melt viscosity as to undesirably tend to be formed into a tube with difficulty.

The DBP oil absorption in the present invention refers to a DBP oil absorption per 100 g where DBP is added to carbon black, and can be measured with an absorptometer. Also, the pH can be determined by measurement with a glass-electrode meter on a mixture of carbon black with distilled water.

The conductive covering layer in the present invention contains a binder resin, which may include thermosetting resins and rubbers.

Stated specifically, the binder resin may include thermosetting resins such as polyvinyl chloride, polyethylene, chlorinated polyethylene, ethylene-propylene copolymer, ethylene-vinyl acetate copolymer, ethylene-ethyl acrylate copolymer, ethylene-methyl acrylate copolymer, styrene-butadiene copolymer, polyurethane, polyamide polyethylene, polypropylene, polyester, polyether, polyamide, polycarbonate, polyacetal, acrylonitrile-butadiene-styrene resin, polystyrene, polyphenylene oxide, polyvinyl acetate, polyvinylidene fluoride and polytetrafluoroethylene; and rubbers such as epichlorohydrin rubber, butyl rubber, nitrile rubber, ethylene-acrylate rubber, ethylene tetrafluoride-perfluoroalkoxyethylene (PFA) rubber, ethylene tetrafluoride-propylene hexafluoride (FEP) rubber, chlorinated rubber and silicone rubber.

Additives added to the binder resin may include, as occasion calls, additional conducting agents, anti-aging agents, softening agents, plasticizers, reinforcing agents and fillers. As the additional conducting agents, graphite and conductive metal oxide may be used. The conductive metal oxide may include, e.g., conductive-treated titanium oxide and conductive-treated zinc oxide.

The conductive covering layer may be formed by coating, and preferably by preparing a seamless tube and covering the support member with the seamless tube obtained. To prepare the seamless tube, first, the binder resin may be kneaded together with the first carbon black and second carbon black and any necessary additives, and subsequently the kneaded product obtained is made into pellets. Next, the pellets thus obtained may be formed into the seamless tube by means of an extruder. Then, the support member may be covered with the seamless tube thus formed, obtaining the conductive member.

To cover the support member with the seamless tube, the seamless tube may be formed in an inner diameter larger than the outer diameter of the support member to be covered with, and the seamless tube may be fitted to the support member, and then shrinked by physical or chemical means, e.g., by heat. Alternatively, the seamless tube may be formed in an inner diameter smaller than the outer diameter of the support member to be covered with, and the seamless tube may be expanded by a physical or chemical means, e.g., by air and then fitted to the support member. The embodiment is disclosed in, e.g., Japanese Patent Application Laid-open No. 10-228156. The present invention, in which a seamless tube suitable for production as described above can also be obtained, can consequently provide a conductive member having very good properties.

The seamless tube in the present invention may preferably have a thickness, but not particularly limited to, from 100 to 600 $\mu$m. It may also be a multi-layer co-extruded tube as disclosed in Japanese Patent Application Laid-open No. 11-125952, without any particular limitations.

In the case of the multi-layer co-extruded tube, it may have a covering layer which does not satisfy the constitution of the present invention. In the present invention, however, the surface layer may preferably contain the first carbon black and second carbon black because any faulty charging can more effectively be prevented.

The construction, materials and production process for the support member used in the present invention and to be covered with the seamless tube are exemplified below.

As a form thereof, an elastic roller may be used. Materials therefor are disclosed in, e.g., Japanese Patent Application Laid-open No. 1-211799. For a conductive substrate, usable are metals such as iron, copper and stainless steel, carbon-dispersed resins, and metal- or metal-oxide-dispersed resins. The substrate may have a shape of a rod or a plate, either of which may be used. For example, the elastic roller may be constituted of the conductive substrate, an elastic layer provided thereon and a conductive layer and/or a resistance layer further provided thereon. The elastic layer may be formed of a rubber such as chloroprene rubber, isoprene rubber, EPDM rubber, polyurethane rubber, epoxy rubber or butyl rubber, or a thermoplastic resin such as styrene-butadiene copolymer, polyurethane, polyester or ethylene-vinyl acetate copolymer. Into these rubber and resin a conducting agent such as carbon, or metal or metal oxide particles may be incorporated.

The conductive layer may be, e.g., a metallized film or may be formed using a conductive-particle-dispersed resin or a conductive resin. As specific examples of these, the metallized film may include deposited films such as films on which aluminum, indium, nickel, copper or iron has been deposited. The conductive-particle-dispersed resin may include, e.g., resins such as polyester, vinyl acetate-vinyl chloride copolymer and polymethyl methacrylate in which any of conductive particles such as carbon, aluminum, nickel and titanium oxide particles have been dispersed. The conductive resin may include quaternary-ammonium-salt-containing polymethyl methacrylate, polyvinyl aniline, polyvinyl pyrrole, polydiacetylene and polyethyleneimine.

The resistance layer may be formed using a conductive resin or a conductive-particle-dispersed insulating resin. As the conductive resin, usable are resins such as ethyl cellulose, nitrocellulose, methoxymethylated nylon, ethoxymethylated nylon, copolymer nylon, polyvinylhydrin and casein. The conductive-particle-dispersed insulating resin may include, e.g., insulating resins such as urethane, polyester, vinyl acetate-vinyl chloride copolymer and polymethyl methacrylate in which any of conductive particles such as carbon, aluminum, indium oxide and titanium oxide particles have been dispersed in a small quantity.

The conductive member constituted according to the present invention, having the support member and the seamless tube, has superior production stability, and the medium-resistance region, whose stable production has ever been considered difficult, can stably be produced.

An example of the construction of a conductive member 1' according to the present invention is shown in FIG. 1. In FIG. 1, reference numeral 1 denotes the conductive substrate; 2, the elastic layer; and 3, the covering layer, in which reference numeral 3(*i*) denotes the conductive layer, and 3(*o*) the conductive covering layer of the present invention. In this instance, the conductive substrate 1, the elastic layer 2 and the conductive layer 3(*i*) are collectively called the support member.

There are no particular limitations on an electrophotographic photosensitive member, an exposure means, a developing means, a transfer means and a cleaning means which are used in the present invention.

Figure 2:
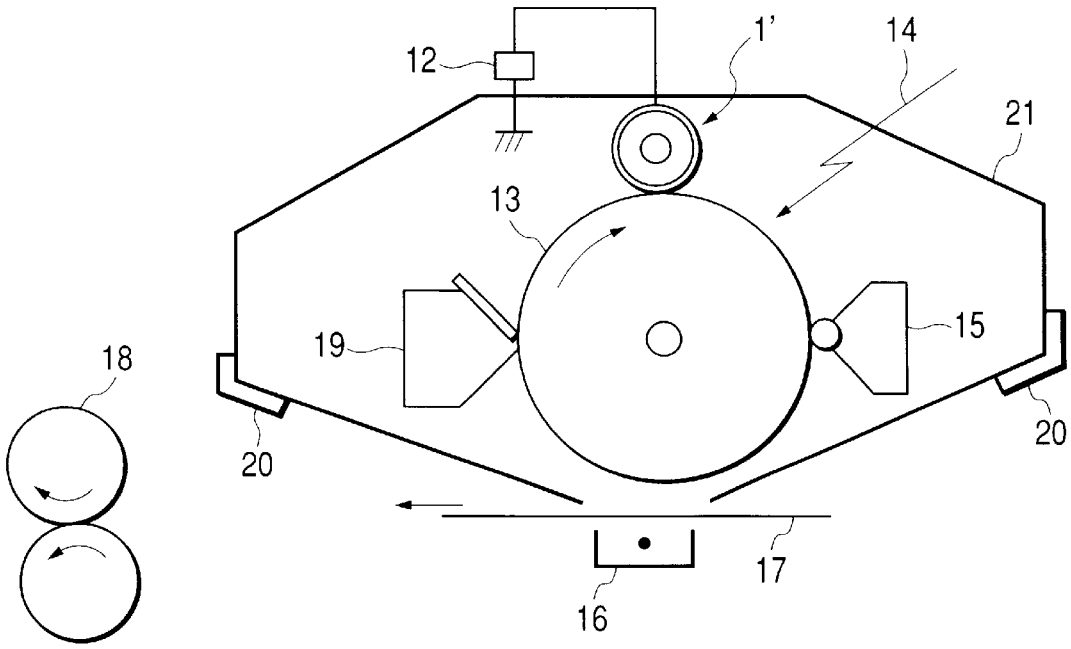
FIG. 2 illustrates an example of the construction of an electrophotographic apparatus provided with a process cartridge having the conductive member of the present invention.

FIG. 2 illustrates an example of the construction of an electrophotographic apparatus provided with a process cartridge having the conductive member of the present invention as a primary charging means.

In FIG. 2, reference numeral 13 denotes the electrophotographic photosensitive member, which is rotatively driven in the direction of an arrow at a stated peripheral speed. The photosensitive member 13 is uniformly electrostatically charged on its periphery to a certain positive or negative potential through the conductive member 1' of the present invention serving as the primary charging means. The photosensitive member thus charged is then exposed to light 14 emitted from an exposure means (not shown) for slit exposure or laser beam scanning exposure. In this way, electrostatic latent images are successively formed on the periphery of the photosensitive member 13.

The electrostatic latent images thus formed are subsequently developed with toner by the operation of a developing means 15. The resulting toner-developed images are then successively transferred by the operation of a transfer means 16 to the surface of a transfer medium 17 fed from a paper feed section (not shown) into between the photosensitive member 13 and the transfer means 16 in such a manner as synchronized with the rotation of the photosensitive member 13.

The transfer medium 17 on which the images have been transferred is separated from the surface of the photosensitive member, is led into an image fixing means 18, where the images are fixed, and is then printed out of the apparatus as a copied material (a copy).

The surface of the photosensitive member 13 from which images have been transferred is brought to removal of the toner remaining after the transfer, through a cleaning means 19. Thus the photosensitive member is cleaned at its surface, and then repeatedly used for the formation of images.

In the present invention, the apparatus may be constituted of a combination of plural components integrally joined as a process cartridge from among the constituents such as the above electrophotographic photosensitive member 13, conductive member 1', developing means 15 and cleaning means 19 so that the process cartridge is detachably mountable to the body of the electrophotographic apparatus such as a copying machine or a laser beam printer. For example, at least the conductive member 1' may be integrally supported in a cartridge together with the photosensitive member 13 to form a process cartridge 21 that is detachably mountable to the body of the apparatus through a guide means such as rails 20 provided in the body of the apparatus.

The present invention is described below in greater detail by giving specific working examples. In the following working examples, a double-layer co-extruded tube (seamless tube) was produced by the method disclosed in Japanese Patent Application Laid-open No. 11-125952. With the seamless tube thus produced, a foamed elastic material layer formed around a substrate was covered to produce the conductive member 1' as shown in FIG. 1. It is constituted of an inner layer which is a low-resistance conductive layer and an outer layer which is the seamless tube according to the present invention. In the following examples, "part(s)" is by weight.

EXAMPLE 1

As materials for the tube outer layer, 5 parts of KETJEN BLACK EC (DBP oil absorption: 360 $cm^3$/100 g), 30 parts of SPECIAL BLACK 250 (DBP oil absorption: 46 $cm^3$/100 g; pH: 3.1), 10 parts of magnesium oxide and 1 part of calcium stearate were added to 100 parts of styrene-butadiene elastomer, and the mixture obtained was kneaded at 200° C. for 15 minutes by means of a pressure kneader, followed by cooling and then pulverization. Thereafter, the pulverized product was formed into pellets by means of a granulating extruder.

As materials for the tube inner layer, 20 parts of KETJEN BLACK EC, 10 parts of magnesium oxide and 1 part of calcium stearate were added to 100 parts of urethane elastomer, and the mixture obtained was kneaded at 200° C. for 15 minutes by means of a pressure kneader, followed by cooling and then pulverization. Thereafter, the pulverized product was formed into pellets by means of a granulating extruder.

The above pellets were extruded by means of a double-layer co-extruder having a die of 16.5 mm in inner diameter and a point of 18.5 mm in outer diameter, followed by the steps of sizing and cooling to fabricate a seamless tube of 11.1 mm in inner diameter, 100 $\mu$m in thickness for the outer layer and 400 $\mu$m in thickness for the inner layer.

EXAMPLE 2

As materials for the tube outer layer, 10 parts of KETJEN BLACK EC (DBP oil absorption: 360 $cm^3$/100 g), 20 parts of SPECIAL BLACK 550 (DBP oil absorption: 47 $cm^3$/100 g; pH: 2.8), 10 parts of magnesium oxide and 1 part of calcium stearate were added to 100 parts of styrene-butadiene elastomer, and the mixture obtained was kneaded at 200° C. for 15 minutes by means of a pressure kneader, followed by cooling and then pulverization. Thereafter, the pulverized product was formed into pellets by means of a granulating extruder. The subsequent procedure in Example 1 was repeated to fabricate a seamless tube of 11.1 mm in inner diameter, 100 $\mu$m in thickness for the outer layer and 400 $\mu$m in thickness for the inner layer.

EXAMPLE 3

As materials for the tube outer layer, 10 parts of KETJEN BLACK EC (DBP oil absorption: 360 $cm^3$/100 g), 30 parts of SPECIAL BLACK 4 (DBP oil absorption: 230 $cm^3$/100 g; pH: 3.0), 10 parts of magnesium oxide and 1 part of calcium stearate were added to 100 parts of styrene-butadiene elastomer, and the mixture obtained was kneaded at 200° C. for 15 minutes by means of a pressure kneader, followed by cooling and then pulverization. Thereafter, the pulverized product was formed into pellets by means of a granulating extruder. The subsequent procedure in Example 1 was repeated to fabricate a seamless tube of 11.1 mm in inner diameter, 100 $\mu$m in thickness for the outer layer and 400 $\mu$m in thickness for the inner layer.

EXAMPLE 4

As materials for the tube outer layer, 10 parts of PRINTEX XE-2 (DBP oil absorption: 380 $cm^3$/100 g), 20 parts of SPECIAL BLACK 250 (DBP oil absorption: 46 $cm^3$/100 g; pH: 3.1), 10 parts of magnesium oxide and 1 part of calcium stearate were added to 100 parts of styrene-butadiene elastomer, and the mixture obtained was kneaded at 200° C. for 15 minutes by means of a pressure kneader, followed by cooling and then pulverization. Thereafter, the pulverized product was formed into pellets by means of a granulating extruder. The subsequent procedure in Example 1 was repeated to fabricate a seamless tube of 11.1 mm in inner diameter, 100 $\mu$m in thickness for the outer layer and 400 $\mu$m in thickness for the inner layer.

Comparative Example 1

As materials for the tube outer layer, 15 parts of KETJEN BLACK EC (DBP oil absorption: 360 $cm^3$/100 g), 20 parts of conductive titanium oxide, 10 parts of magnesium oxide and 1 part of calcium stearate were added to 100 parts of styrene-butadiene elastomer, and the mixture obtained was kneaded at 200° C. for 15 minutes by means of a pressure kneader, followed by cooling and then pulverization. Thereafter, the pulverized product was formed into pellets by means of a granulating extruder. Using the same tube inner-layer materials as those in Example 1, the subsequent procedure in Example 1 was repeated to fabricate a seamless tube of 11.1 mm in inner diameter, 100 $\mu$m in thickness for the outer layer and 400 $\mu$m in thickness for the inner layer.

Comparative Example 2

As materials for the tube outer layer, 10 parts of KETJEN BLACK EC (DBP oil absorption: 360 $cm^3$/100 g), 20 parts of TOHKA BLACK #4500 (DBP oil absorption: 168 $cm^3$/100 g; Ph: 7), 10 parts of magnesium oxide and 1 part of calcium stearate were added to 100 parts of styrene-butadiene elastomer, and the mixture obtained was kneaded at 200° C. for 15 minutes by means of a pressure kneader, followed by cooling and then pulverization. Thereafter, the pulverized product was formed into pellets by means of a granulating extruder. Using the same tube inner-layer materials as those in Example 1, the subsequent procedure in Example 1 was repeated to fabricate a seamless tube of 11.1 mm in inner diameter, 100 $\mu$m in thickness for the outer layer and 400 $\mu$m in thickness for the inner layer.

In the conductive member (conductive roller) 1' shown in FIG. 1, a mandrel 1 made of stainless steel is covered on its periphery with a foamed elastic material layer 2 formed of a conducting elastic material. This foamed elastic material layer 2 is further covered on its periphery with the above seamless tube. In the case of the conductive roller shown in FIG. 1, it is constituted of an inner layer 3(*i*) which is the low-resistance conductive layer and an outer layer 3(*o*) which is the seamless tube according to the present invention. This roller was installed in the process cartridge shown in FIG. 2.

To make an evaluation on any changes in electrical resistance during use under electrification, the conductive roller 1' was only electrified for 10 hours with a construction in which the exposure light 14, the toner of the developing means 15, the transfer means 16 and the transfer medium 17 had been removed. Here, the applied voltage was a pulse-wise voltage formed by superimposing on a DC voltage of −670 V an AC voltage with a peak-to-peak voltage of 2 kV and a frequency of 1.3 kHz.

In this condition, the resistance value at the initial stage and the resistance value under the application of electric current for 10 hours were measured. Here, the resistance value was determined on the basis of electric currents measured when the roller was brought into contact with a stainless-steel drum of 30 mm in diameter and a DC voltage of −200 V was applied while the stainless-steel drum was rotated at 30 rpm.

Results obtained are shown in Table 1 below. As can be seen from the results, the rollers making use of the tubes of Comparative Examples 1 and 2 showed an increase in the resistance value by about two figures, whereas the rollers making use of the tubes of Examples 1 to 4 kept the increase in the resistance value at only one figure or less.

TABLE 1

| | Initial stage (Ω · cm) | After 10 hours (Ω · cm) | Initial stage/ after 10 hours |
|---|---|---|---|
| Example: | | | |
| 1 | $1.2 \times 10^9$ | $9.0 \times 10^9$ | 7.5 |
| 2 | $6.0 \times 10^8$ | $5.0 \times 10^9$ | 8.3 |
| 3 | $2.0 \times 10^9$ | $1.0 \times 10^{10}$ | 5.0 |
| 4 | $1.5 \times 10^8$ | $1.5 \times 10^9$ | 10 |
| Comparative Example: | | | |
| 1 | $1.8 \times 10^8$ | $4.0 \times 10^{10}$ | 220 |
| 2 | $4.2 \times 10^7$ | $2.0 \times 10^9$ | 48 |

What is claimed is:

1. A conductive member which is to be disposed in contact with an electrophotographic photosensitive member and to which a voltage is to be applied; the conductive member comprising a support member and a conductive covering layer provided on the support member;

said conductive covering layer comprising both a first carbon black having a DBP oil absorption of from 300 $cm^3$/100 g to 500 $cm^3$/100 g and a second carbon black having a DBP oil absorption of 250 $cm^3$/100 g or smaller and exhibiting pH of 5 or below.

2. A conductive member according to claim 1, wherein said first carbon black has a DBP oil absorption of from 300 $cm^3$/100 g to 400 $cm^3$/100 g.

3. A conductive member according to claim 1 or 2, wherein said second carbon black has a DBP oil absorption of from 30 $cm^3$/100 g to 100 $cm^3$/100 g.

4. A conductive member according to claim 1, wherein said conductive covering layer contains a binder resin, and said first carbon black and second carbon black are in a content of from 5 parts by weight to 50 parts by weight in total, based on 100 parts by weight of the binder resin.

5. A conductive member according to claim 4, wherein the content of said first carbon black and second carbon black is from 20 parts by weight to 40 parts by weight in total, based on 100 parts by weight of the binder resin.

6. A conductive member according to claim 1, wherein said first carbon black and said second carbon black are in a proportion of from 1:1 to 1:15 in weight ratio.

7. A conductive member according to claim 1, wherein said conductive covering layer has a volume resistivity of from $1\times10^4$ Ω·cm to $1\times10^{11}$ Ω·cm.

8. A process cartridge comprising:

an electrophotographic photosensitive member and a conductive member which is disposed in contact with the electrophotographic photosensitive member and to which a voltage is to be applied;

said electrophotographic photosensitive member and conductive member being integrally supported and being detachably mountable to the body of an image-forming apparatus; and said conductive member comprising a support member and a conductive covering layer provided on the support member;

said conductive covering layer comprising both a first carbon black having a DBP oil absorption of from 300 $cm^3$/100 g to 500 $cm^3$/100 g and a second carbon black having a DBP oil absorption of 250 $cm^3$/100 g or smaller and exhibiting a pH of 5 or below.

9. A process cartridge according to claim 8, wherein said first carbon black has a DBP oil absorption of from 300 $cm^3$/100 g to 400 $cm^3$/100 g.

10. A process cartridge according to claim 8 or 9, wherein said second carbon black has a DBP oil absorption of from 30 $cm^3$/100 g to 100 $cm^3$/100 g.

11. A process cartridge according to claim 8, wherein said conductive covering layer contains a binder resin, and said first carbon black and second carbon black are in a content of from 5 parts by weight to 50 parts by weight in total, based on 100 parts by weight of the binder resin.

12. A process cartridge according to claim 11, wherein the content of said first carbon black and second carbon black is from 20 parts by weight to 40 parts by weight in total, based on 100 parts by weight of the binder resin.

13. A process cartridge according to claim 8, wherein said first carbon black and said second carbon black are in a proportion of from 1:1 to 1:15 in weight ratio.

14. A process cartridge according to claim 8, wherein said conductive covering layer has a volume resistivity of from $1\times10^4$ Ω·cm to $1\times10^{11}$ Ω·cm.

15. An electrophotographic apparatus comprising:

an electrophotographic photosensitive member and a conductive member which is disposed in contact with the electrophotographic photosensitive member and to which a voltage is to be applied;

said conductive member comprising a support member and a conductive covering layer provided on the support member; and said conductive covering layer comprising both a first carbon black having a DBP oil absorption of from 300 $cm^3$/100 g to 500 $cm^3$/100 g and a second carbon black having a DBP oil absorption of 250 $cm^3$/100 g or smaller and exhibiting a pH of 5 or below.

16. An electrophotographic apparatus according to claim 15, wherein said first carbon black has a DBP oil absorption of from 300 $cm^3$/100 g to 400 $cm^3$/100 g.

17. An electrophotographic apparatus according to claim 15 or 16, wherein said second carbon black has a DBP oil absorption of from 30 $cm^3$/100 g to 100 $cm^3$/100 g.

18. An electrophotographic apparatus according to claim 15, wherein said conductive covering layer contains a binder resin, and said first carbon black and second carbon black are in a content of from 5 parts by weight to 50 parts by weight in total, based on 100 parts by weight of the binder resin.

19. An electrophotographic apparatus according to claim 18, wherein the content of said first carbon black and second carbon black is from 20 parts by weight to 40 parts by weight in total, based on 100 parts by weight of the binder resin.

20. An electrophotographic apparatus according to claim 15, wherein said first carbon black and said second carbon black are in a proportion of from 1:1 to 1:15 in weight ratio.

21. An electrophotographic apparatus according to claim 15, wherein said conductive covering layer has a volume resistivity of from $1\times10^4$ Ω·cm to $1\times10^{11}$ Ω·cm.

* * * * *

UNITED STATES PATENT AND TRADEMARK OFFICE

CERTIFICATE OF CORRECTION

PATENT NO. : 6,470,162 B2
DATED : October 22, 2002
INVENTOR(S) : Hiroshi Abe et al.

It is certified that error appears in the above-identified patent and that said Letters Patent is hereby corrected as shown below:

Title page,
Item [73], Assignee, should read:
-- Canon Kasei Kabushiki Kaisha
1888-2, Kukizaki, Kukizaki-Machi
Inashiki-gun, Ibaraki-ken
Japan --

Signed and Sealed this

Sixth Day of January, 2004

JAMES E. ROGAN
*Director of the United States Patent and Trademark Office*